United States Patent [19]

Stoltman

[11] 3,978,175

[45] Aug. 31, 1976

[54] ENGINE AIR-FUEL RATIO CONTROL MEANS

[75] Inventor: Donald D. Stoltman, Henrietta, N.Y.

[73] Assignee: General Motors Corporation, Detroit, Mich.

[22] Filed: May 12, 1975

[21] Appl. No.: 576,618

[52] U.S. Cl. ..... 261/50 A; 261/51; 261/69 R; 123/139 AW; 137/85; 137/596.17; 137/627.5

[51] Int. Cl.[2] ..... F02M 7/22

[58] Field of Search ..... 261/50 A, 69 R, 51; 123/139 AW; 137/85, 596.17, 627.5

[56] References Cited

UNITED STATES PATENTS

| | | | |
|---|---|---|---|
| 3,278,173 | 10/1966 | Cook et al. | 261/50 A |
| 3,455,260 | 7/1969 | Mennesson | 261/50 A |
| 3,605,813 | 9/1971 | Nakano et al. | 137/627.5 |
| 3,650,258 | 3/1972 | Jackson | 261/50 A |
| 3,677,241 | 7/1972 | Gele et al. | 261/50 A |
| 3,739,762 | 6/1973 | Jackson | 123/139 AW |
| 3,869,528 | 3/1975 | Mick | 261/50 A |
| 3,906,910 | 9/1975 | Szlaga, Jr. | 261/50 A |

*Primary Examiner*—Tim R. Miles
*Attorney, Agent, or Firm*—Robert M. Sigler

[57] ABSTRACT

An electromagnetic vacuum regulator responds to an electrical signal to supply a regulated vacuum output to vacuum sensitive air-fuel ratio control means in an engine carburetor, the air-fuel ratio control means providing a leaner air-fuel ratio with increasing manifold vacuum. The vacuum regulator includes a regulated vacuum output connected to the air-fuel ratio control means, a constant pressure input connected to a source of constant low vacuum and a variable pressure input normally supplied with the engine manifold vacuum so that the regulated output vacuum is normally always greater than the constant vacuum supplied to the constant pressure input. The carburetor throttle mechanism, however, includes means to actuate a valve opening the variable pressure inlet to the atmosphere during wide open throttle so that the regulated vacuum outlet supplies atmospheric pressure for a richer than normal air-fuel ratio regardless of the electric signal.

3 Claims, 4 Drawing Figures

ENGINE AIR-FUEL RATIO CONTROL MEANS

SUMMARY OF THE INVENTION

This invention relates to means for controlling air-fuel ratio in carburetors and particularly for means providing a normal range of air-fuel ratios for normal engine operation and a special air-fuel ratio, richer than the richest normal air-fuel ratio, for wide-open throttle engine operation.

This invention has special application to an air-fuel ratio control system wherein an electromagnetic vacuum regulator is responsive to an electric signal to supply a vacuum signal to vacuum sensitive air-fuel ratio control means in the carburetor. The vacuum regulator has a regulated vacuum outlet connected to the air-fuel ratio control means, an electric signal input, a constant pressure inlet connected to a source of constant low vacuum, and a variable pressure inlet normally supplied with engine manifold induction vacuum. In the special case of an air-valve carburetor, the depression chamber between the air-valve and throttle valve is a convenient source of constant low vacuum for the constant pressure inlet. Under normal operation, the vacuum regulator supplies a regulated vacuum output to the air-fuel ratio control means which cannot be less than the constant low vacuum. This insures an upper limit on the richness of the air-fuel ratio.

The carburetor throttle mechanism includes means to open a valve and supply atmospheric air to the variable pressure inlet of the vacuum regulator. This causes the vacuum regulator to supply atmospheric pressure to the air-fuel ratio control means regardless of the electric signal to create a special richer air-fuel ratio as long as the valve is open. Closure of the throttle from its wide open position with resultant closure of the valve and reapplication of manifold induction vacuum to the variable pressure inlet of the vacuum regulator restores control of air-fuel ratio to the electric signal.

Further details and advantages of this invention will be apparent from the accompanying drawings and following description of the preferred embodiment.

DESCRIPTION OF THE PREFERRED EMBODIMENT

Figure 1:
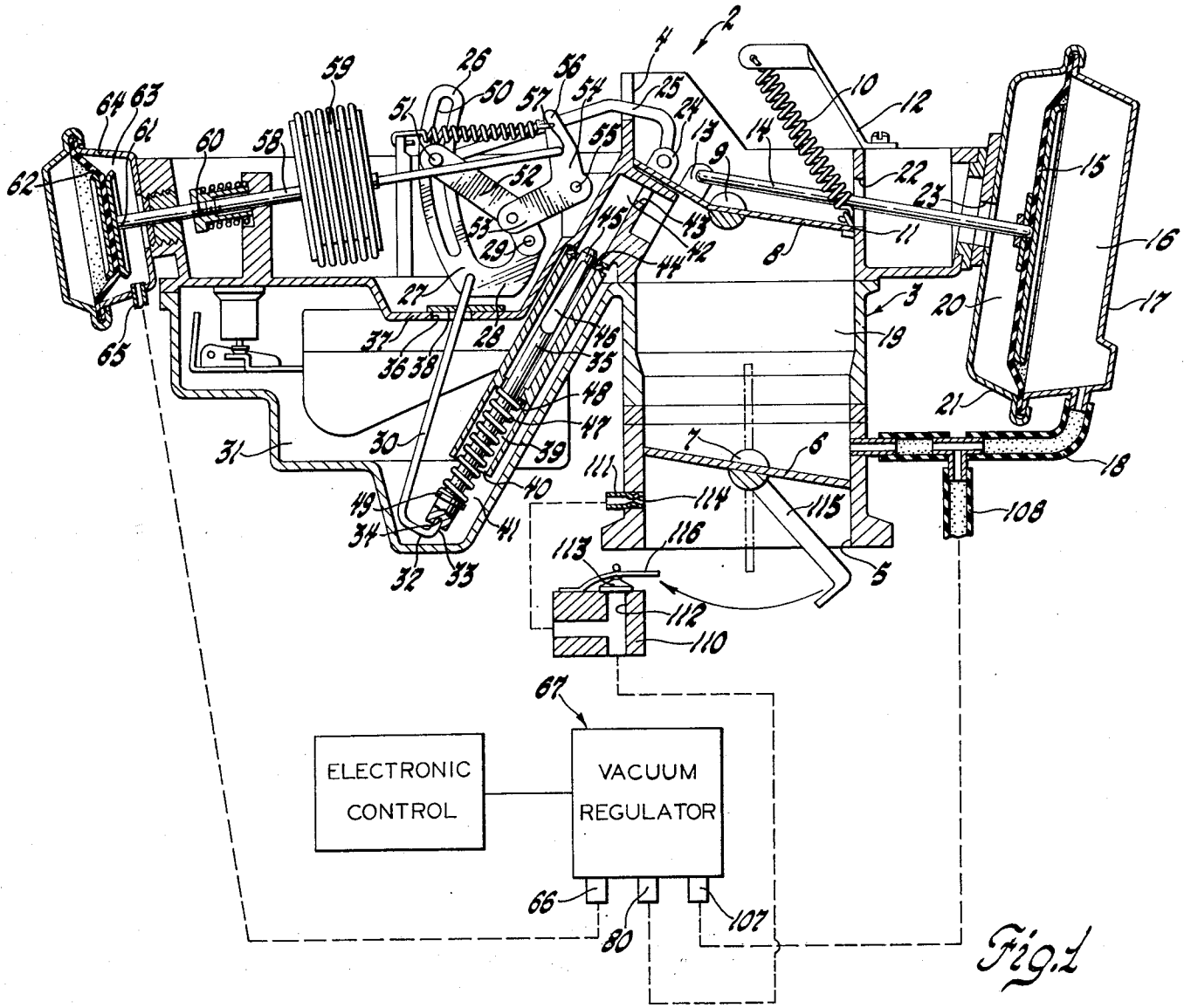
FIG. 1 is a partially schematic representation of this invention.

Referring to FIG. 1, a carburetor 2 supplies air and fuel in a controlled ratio to a conventional engine, not shown. Carburetor 2 can be any carburetor having means for controlling the air-fuel ratio in response to a vacuum signal; the example shown is an air-valve carburetor described in the U.S. patent application 343,553 of John A. Gural et al, filed Mar. 21, 1973, now U.S. Pat. No. 3,882,206.

Carburetor 2 has a mixture conduit 3 including an air inlet 4 and a mixture outlet 5 which discharges through a standard intake manifold, not shown, to the engine. A throttle 6 is disclosed in mixture outlet 5 in the usual manner on a throttle shaft 7.

An air valve 8 is disposed in air inlet 4 on an air valve shaft 9. A spring 10 is hooked over the downstream edge 11 of air valve 8 or otherwise attached thereto and extends to a bracket 12 to bias air valve 8 to the position shown.

A tang 13 reaches upwardly from air valve 8 and is connected by a link 14 to a diaphragm 15. A chamber 16, formed between the right side of diaphragm 15 and a cover member 17, is connected by a tube 18 to a region 19 of mixture conduit 3 defined between air valve 8 and throttle 6.

A chamber 20, defined between the left side of diaphragm 15 and a cover member 21, is subjected to substantially atmospheric pressure, present in air inlet 4 through openings 22 and 23.

In operation, chamber 16 is subjected to the subatmospheric pressure created in region 19 as throttle 6 is open and diaphragm 16 acts through link 14 to pull air valve 8 clockwise to an open position. Spring 10 is effective to balance the opening force of diaphragm 15, thereby creating a substantially constant vacuum in region 19. By thus establishing a generally constant pressure drop across air valve 8, the area about air valve 8 and thus the rotative position of air valve 8 is determined by and is a measure of the rate of air flow through mixture conduit 3.

A tab 24 extends upwardly from air valve 8 and is connected through a link 25 to one end 26 of a lever 27. The opposite end 28 of lever 27 is pivoted about a pin 29. Between ends 26 and 28, a hanger 30 extends from lever 27 into a carburetor fuel bowl 31. The lower end 32 of hanger 30 has a hook 33 which is received in a recess 34 formed in a metering rod 35.

Hanger 30 extends through an opening 36 in the cover 37 of fuel bowl 31. Opening 36 is closed by a slider 38 which shifts horizontally during movement of hanger 30.

Metering rod 35 is disposed in a fuel passage 39 having its lower end 40 disposed to receive fuel from a well 41 formed in the bottom of fuel bowl 31. The upper end 42 of fuel passage 39 has an opening 43 through which fuel is discharged into region 19 of mixture conduit 3. It will be appreciated, therefore, that the fuel in fuel bowl 31 is subjected to a substantially constant metering head — from the substantially atmospheric pressure in the upper portion of the fuel bowl to the generally constant lower pressure in region 19.

A metering jet or orifice 44 is disposed in fuel passage 39 around the tip 45 of metering rod 35. Metering rod 35 is supplied with at least one tapered surface 46 which, upon reciprocation of metering rod 35 in jet 44, varies the area available for fuel flow through jet 44.

In operation, as air valve 8 opens by clockwise rotation, link 25 rotates lever 27 in a clockwise direction. Lever 27 then lifts hanger 30 to move metering rod 35 generally upwardly and rightwardly in fuel passage 39. Thus as air valve 22 is opened to increase the area available for air flow through air inlet 4, metering rod 35 is shifted to increase the area available for fuel flow through metering orifice 44. By this means, a substantially constant air-fuel ratio may be maintained — the precise proportion being controlled by the geometry of the tapered surface 46 and of the linkage between air valve 8 and metering rod 35.

A spring 47 extends from a ledge 48 formed in fuel passage 39 to the lower end 49 of metering rod 35 to take up any slack in the linkage and to load metering rod 35 against jet 44.

A slot 50 is formed in the end 26 of lever 27. Link 25 is connected to lever 27 by having one end 51 disposed in slot 50. A link 52 extends from end 51 to an arm 53 of a supplementary lever 54 pivoted at 55. The opposite arm 56 of supplementary lever 54 is connected to one end 57 of linkage 58, which includes aneroid atmospheric pressure compensation means 59 and manual adjustment means 60 as described more fully in the reference patent. The other end 61 of linkage 58 is attached to a diaphragm 62. A chamber 63 defined between the right side of diaphragm 62 and a cover member 64 is an actuation chamber for air-fuel ratio control means comprising linkage 58, supplementary lever 54, link 52, and lever 27 with slot 26. The position of metering rod 35 in relation to air valve 8 and thus the air-fuel ratio of carburetor 2, is controlled by the level of vacuum, relative to atmospheric pressure, applied to chamber 63 through a conduit 65 from the regulated vacuum outlet 66 of a vacuum regulator 67.

Figure 2:
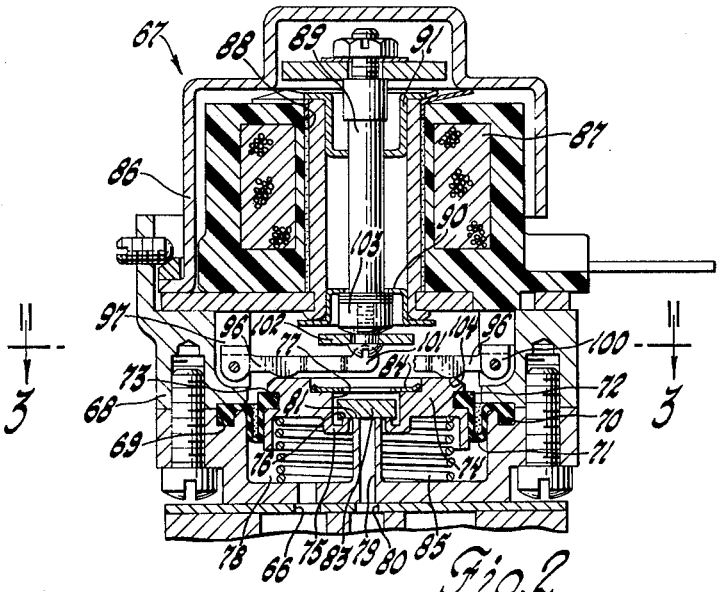
FIG. 2 is a cutaway view of a vacuum regulator suitable for use in this invention.
Figure 3:
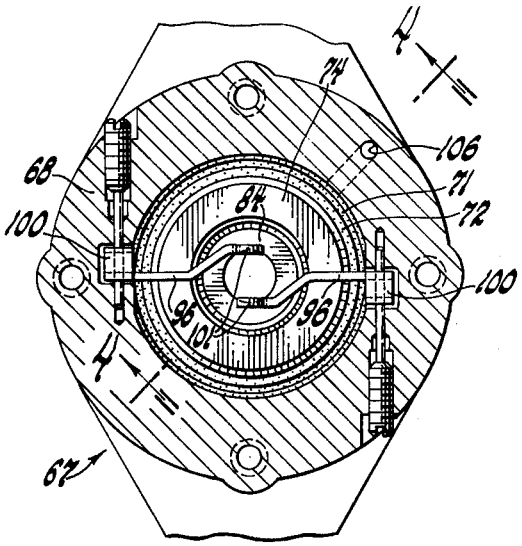
FIG. 3 is a view along line 3—3 in FIG. 2.
Figure 4:
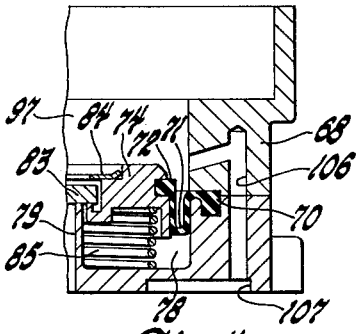
FIG. 4 is a view along line 4—4 in FIG. 3.

Vacuum regulator 67, one example of a number of similar devices, is shown in detail in FIGS. 2, 3 and 4. Regulator 67 comprises a lower housing member 68 retaining, in a circumferential pocket 69, the outer peripheral bead 70 of an annular diaphragm 71. The inner peripheral bead 72 of diaphragm 71 is retained in a circumferential pocket 73 of an annular platform 74 axially movable within lower housing member 68. At the center of annular platform 74, a central flange 75 extends upward to form a valve seat 76 around an opening 77 through annular platform 74.

Lower housing member 68, diaphragm 71 and annular platform 74 define an outlet chamber 78 communicating with regulated vacuum outlet 66. A hollow tube 79 extends upward from lower housing member 68 through outlet chamber 78 into opening 77 in annular platform 74. The lower end of tube 79 defines a variable pressure inlet 80 for vacuum regulator 67; and the upper end of tube 79 defines a valve seat 81 coaxial with valve seat 76. A disk shaped valve member 83 is retained in opening 77 by an annular retainer 84 and is effective, depending upon the vertical position of annular platform 74, to close valve seat 76 or valve seat 81 or both. A coil spring 85 is compressed between lower housing member 68 and annular platform 74 within outlet chamber 78 to exert an upward force on platform 74.

An upper housing member 86 attached to the top of lower housing member 68 retains an annular electromagnet 87 of conventional design having a central opening 88 axially aligned with platform 74. A magnetically responsive plunger 89, guided by annular guides 90 and 91 at its lower and upper ends, respectively, is axially reciprocable in central opening 88. The position and magnetic response of plunger 89 are such that current through electromagnet 87 produces a downward force on plunger 89.

A pair of levers 96 are contained within a constant pressure chamber 97 defined above annular diaphragm 71 and platform 74 within lower housing member 68 and upper housing member 86. Each lever 96 has one end 100 pivoted on lower housing member 68 and another end 101 abutted from above by a plate 102 attached to the lower end 103 of plunger 89. Between ends 100 and 103 on each lever 96, a contact 104 bears downward on annular platform 74.

Platform 74 is thus subjected to the downward force of plunger 89 exerted through levers 96, the upward force of spring 85 and the force due to the differential pressure in chambers 78 and 97 across platform 74 and diaphragm 71. Platform 74 may assume a central position defined as that vertical position in which valve member 83 contacts both valve seats 76 and 81 to prevent communication between either constant chamber 97 or variable pressure inlet 80 and outlet chamber 78. If annular platform 74 moves upward in FIG. 2, valve member 83 is lifted from valve seat 81 to establish communication between variable pressure inlet 80 and outlet chamber 78. If annular platform 74 moves downward from its central position, valve seat 76 is pulled away from valve member 83 to establish communication between constant pressure chamber 97 and outlet chamber 78.

As seen in FIG. 4, constant pressure chamber 97 is connected through a passage 106 to a constant pressure inlet 107. Constant pressure inlet 107 is communicated through a conduit 108, which is joined to conduit 18, to the constant vacuum region 19 of mixture conduit 3 in carburetor 2. Thus the constant vacuum present in region 19 is also supplied to constant pressure chamber 97 to vacuum regulator 67.

Referring again to FIG. 1, variable pressure inlet 80 is communicated through a valve member 110 and conduit 111 to the mixture outlet 5 below throttle 6. Valve assembly 110 has an opening 112 to the atmosphere which is normally closed by valve member 113 on spring lever 116. Thus, normally, engine manifold vacuum present below throttle 6 is supplied to the variable pressure inlet 80 of vacuum regulator 67. Conduit 111 is provided with a restriction 114 between mixture conduit 3 and opening 112.

Throttle 6 is provided with means effective, upon full opening of throttle 6 to its wide open throttle position, to engage and move valve member 113 to open opening 112 to the atmosphere. Such means might comprise, for example, an arm 115 fixed to throttle shaft 7 and effective to rotate and engage spring lever 116 to pull valve member 113 away from opening 112 when throttle 6 reaches its wide open position. Since opening 112 has greater flow area than restriction 114, atmospheric pressure is supplied to the variable pressure inlet 80 of vacuum regulator 67. Restriction 114 minimizes intake of air through opening 112 and conduit 111 to mixture conduit 3.

The operation of vacuum regulator 67 under normal and wide open throttle conditions will now be described. For a given electric current in electromagnet 87, the position of platform 74 will be determined by the pressure differential thereacross. In normal operation, with the constant low vacuum from region 19 supplied to chamber 97 above platform 74, one particular vacuum level in chamber 78 greater than that in chamber 97 will position platform 74 at its central position. If output vacuum in chamber 78 falls below that given vacuum level, platform 74 will rise to open variable pressure inlet 80, which is supplied with manifold vacuum, to chamber 78. This will cause the vacuum in chamber 78 to increase and lower platform 74 to its central position. Similarly, if the vacuum in chamber 78 increases beyond that certain level, platform 74 will fall to open opening 77 between chambers 78 and 97. The low vacuum in chamber 97 will thus be supplied to chamber 78 to decrease the vacuum level therein until platform 74 rises again to its central position. Thus platform 74 continually oscillates through its central position to regulate the output vacuum in chamber 78 at the particular level corresponding to a given current level in electromagnet 87.

If the current level in electromagnet 87 should rise, the downward force exerted by plunger 89 increases and a smaller vacuum in chamber 78 is required to place platform 74 in its central position. The immediate effect of such a current increase would be to push platform 74 downward to reduce vacuum level in chamber 78 until the new given vacuum level is reached, whereupon the new level is maintained as previously described. Similarly a decrease in current in electromagnet 87 leads to an increased vacuum level in chamber 78. There is a specific inverse relationship between the electric current input to electromagnet 87 and the regulated vacuum output from chamber 78 through outlet 66. By this means, the air-fuel ratio of carburetor 2 can be controlled according to the electrical input to regulator 67.

It should be noted that the minimum vacuum level obtainable from outlet 66 in the previously described normal operation is that corresponding to the constant low vacuum in region 19 which is supplied to chamber 97. The regulated output vacuum must vary between that level and engine manifold vacuum; and this places an upper limit on the obtainable richness of the air-fuel mixture in carburetor 2.

In wide-open throttle operation, atmospheric pressure is supplied to constant pressure inlet 80 from opening 112. The next time that platform 74 moves upward to pull valve member 83 from valve seat 81, the atmospheric pressure at inlet 80 will be communicated to chamber 78. This will happen very quickly, since valve member 74 is continually oscillating through its central position. The increase in pressure in chamber 78, however, pushes platform 74 upward and prevents it from falling back to its central position. As long as atmospheric pressure is supplied to variable pressure inlet 80, it will be communicated through chamber 78 and outlet 66 to chamber 63 in carburetor 2, where it drives the air-fuel ratio control means to produce a mixture greater than the richest mixture obtainable in normal operation. This rich mixture provides added power for engine acceleration associated with wide-open throttle operation. Upon the cessation of wide-open throttle operation and the closure of valve member 113, manifold vacuum is once again supplied to variable pressure inlet 80; and vacuum regulator 67 once again assumes its normal operation.

This embodiment has numerous equivalents which will occur to those skilled in the art. These should be considered within the scope of this invention, which should be limited only by the following claims.

The embodiments of the invention in which an exclusive property or privilege is claimed are defined as follows:

1. Air-fuel ratio control apparatus for an internal combustion engine capable of providing a normal range of air-fuel ratios and an air-fuel ratio separate from said normal range on the rich side thereof, the engine including means for providing air and fuel in a ratio varying inversely with a vacuum signal, means for generating the vacuum signal, the vacuum signal generating means having a first pressure inlet, a second pressure inlet, a vacuum signal outlet, a differential pressure motor connected across the first pressure inlet and vacuum signal outlet and movable in response to the differential pressure thereacross, valve means actuable by movement of the differential pressure motor to a central position to close the vacuum signal outlet from both the first and second inlet, the valve means being further actuable by movement of the differential pressure motor in one direction from the central position due to decreasing pressure in the vacuum signal outlet relative to the first pressure inlet to open the vacuum signal outlet to the first pressure inlet and by movement of the differential pressure motor in the opposite direction from the central position due to increasing pressure in the vacuum signal outlet relative to the first pressure inlet to open the vacuum signal outlet to the second pressure inlet, and means for applying a varying force to the differential pressure motor; the air-fuel ratio control apparatus comprising:

a source of constant vacuum connected to the first pressure inlet; a source of vacuum greater than the constant vacuum normally connected to the second pressure inlet, whereby the vacuum signal is normally responsive to the varying force to control the engine air-fuel ratio within its normal range; and means for supplying air at atmospheric pressure to the second pressure inlet in place of the greater vacuum, whereby atmospheric pressure is provided at the vacuum signal outlet and the air and fuel providing apparatus provides air and fuel in the separate ratio.

2. A carburetor for an internal combustion engine comprising: a body with an induction throat and a throttle valve therein; means for providing and mixing air and fuel in the induction throat for delivery to said engine in a ratio varying inversely with a vacuum signal; means for generating the vacuum signal, said means comprising a valve body with a first pressure inlet, a second pressure inlet and a vacuum signal outlet, a differential pressure motor connected between the vacuum signal outlet and first pressure inlet and movable in response to the pressure differential therebetween in opposite directions from a central position, valve means in the valve body actuable by movement of the differential pressure motor to its central position to close the vacuum signal outlet from both first and second inlets and by movement of the differential pressure motor from its central position in one direction due to decreasing pressure in the vacuum signal outlet relative to the first pressure inlet to open the vacuum signal outlet to the first pressure inlet and in the opposite direction from its central position due to increasing pressure in the vacuum signal outlet relative to the first pressure inlet to open the vacuum signal outlet to the second pressure inlet, and means for applying a variable force to the differential pressure motor in response to a control signal; a source of constant low vacuum in communication with the first pressure inlet, the constant low vacuum being less than that existing in the induction throat below the throttle valve; a conduit normally communicating the second pressure inlet with the induction throat below the throttle valve, whereby the ratio of air and fuel supplied by the carburetor varies within a normal range according to the control signal; and an air bleed valve in the conduit actuable to admit air at atmospheric pressure to the second pressure inlet; whereby the ratio of air and fuel supplied by the carburetor assumes a value outside and separate from the normal range on the rich side thereof.

3. The carburetor of claim 2 including means to actuate the air bleed valve in response to the movement of the throttle valve to its wide-open position.

* * * * *